US011028839B2

(12) United States Patent
Hashimoto et al.

(10) Patent No.: US 11,028,839 B2
(45) Date of Patent: Jun. 8, 2021

(54) COMPRESSING DEVICE AND METHOD FOR CARRYING OUT COMPRESSING DEVICE

(71) Applicant: KOBE STEEL, LTD., Hyogo (JP)

(72) Inventors: Koichiro Hashimoto, Takasago (JP); Kenji Nagura, Takasago (JP); Takuya Washio, Takasago (JP); Ryosuke Mori, Takasago (JP); Daisuke Wada, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 16/403,765

(22) Filed: May 6, 2019

(65) Prior Publication Data

US 2019/0353306 A1 Nov. 21, 2019

(30) Foreign Application Priority Data

May 21, 2018 (JP) ..... JP2018-097114

(51) Int. Cl.
*F17C 13/08* (2006.01)
*F04B 53/10* (2006.01)
(Continued)

(52) U.S. Cl.
CPC ..... *F04B 39/14* (2013.01); *B66C 1/105* (2013.01); *B66C 13/08* (2013.01); *B66C 17/06* (2013.01);
(Continued)

(58) Field of Classification Search
CPC .... F04B 39/14; F04B 39/127; F04B 53/1097; F04B 53/22; F04B 39/10; F04B 53/10;
(Continued)

(56) References Cited

U.S. PATENT DOCUMENTS 4,950,012 A * 8/1990 Jones ..... B66C 1/105 294/67.2
5,064,079 A * 11/1991 Bowerman ..... B66C 19/02 212/175
(Continued)

FOREIGN PATENT DOCUMENTS

CN 204643641 U 9/2015
CN 207046736 U 2/2018
(Continued)

OTHER PUBLICATIONS

The extended European search report issued by the European Patent Office dated Jul. 15, 2019, which corresponds to European Patent Application No. 19171523.4—1004 and is related to U.S. Appl. No. 16/403,765.

*Primary Examiner* — Dominick L Plakkoottam
(74) *Attorney, Agent, or Firm* — Studebaker & Brackett PC

(57) ABSTRACT

The present application includes a compressor having a cylinder forming a compression chamber in which gas is compressed, a housing having a peripheral wall forming an internal space in which the compressor is stored, and a supporting member situated above the compressor in the internal space. The peripheral wall includes an opening wall in which a carry-out port is formed through which the cylinder is carried out. The supporting member extends to guide movement of a first lifting device between a position above the compressor and a position above the carry-out port. The cylinder is hung from the first lifting device.

5 Claims, 7 Drawing Sheets

(51) Int. Cl.

| | |
|---|---|
| ***F17C 13/00*** | (2006.01) |
| ***E05F 15/70*** | (2015.01) |
| ***E05F 7/06*** | (2006.01) |
| ***E05D 15/52*** | (2006.01) |
| ***F04B 39/14*** | (2006.01) |
| ***B66C 13/08*** | (2006.01) |
| ***F04B 39/12*** | (2006.01) |
| ***B66C 1/10*** | (2006.01) |
| ***B66C 17/06*** | (2006.01) |

(52) U.S. Cl.
CPC ..... *E05D 15/5208* (2013.01); *F04B 39/127* (2013.01); *F04B 53/1097* (2013.01); *F04B 39/122* (2013.01)

(58) Field of Classification Search
CPC B66C 17/06; B66C 1/22; B66C 23/22; B66C 1/62; B66C 1/105; B66C 1/107; B66C 23/203; B66C 23/48; E05D 15/5208; B23P 6/00; E06C 7/12; F24F 1/10; F24F 1/60; Y10S 212/901
See application file for complete search history.

(56) References Cited

U.S. PATENT DOCUMENTS

| | | | | |
|---|---|---|---|---|
| 5,337,908 | A * | 8/1994 | Beck, Jr. ..... | A61G 7/1015 104/126 |
| 7,857,288 | B2 * | 12/2010 | Dunlap ..... | B66C 5/025 254/324 |
| 10,196,243 | B1 * | 2/2019 | Wells ..... | B66C 17/06 |
| 10,486,946 | B1 * | 11/2019 | Wells ..... | B66C 1/22 |
| 2007/0134079 | A1 * | 6/2007 | Rader ..... | B66C 23/22 414/325 |
| 2014/0161638 | A1 | 6/2014 | Lardy et al. | |
| 2016/0245019 | A1 * | 8/2016 | Gregory ..... | E06C 7/12 |
| 2016/0348840 | A1 | 12/2016 | Nagura et al. | |
| 2018/0274726 | A1 | 9/2018 | Nagura et al. | |

FOREIGN PATENT DOCUMENTS

| | | | |
|---|---|---|---|
| JP | 2009-264235 | A | 11/2009 |
| KR | 10-2013-0081460 | A | 7/2013 |

* cited by examiner

COMPRESSING DEVICE AND METHOD FOR CARRYING OUT COMPRESSING DEVICE

TECHNICAL FIELD

The present invention relates to a compressing device configured to compress gas in a housing and a method for carrying out a cylinder portion of the compressing device.

BACKGROUND ART

Compressed gas may be supplied outdoors (e.g. a hydrogen station). In this case, a compressor configured to compress the gas is situated outdoors. For protecting the compressor situated outdoors against wind and weather, the compressor is placed in a housing.

For maintenance work of the compressor; the compressor may be disassembled in the housing. JP 2015-232384 A proposes taking out disassembled parts of the compressor through an opening portion formed on a roof of the housing.

With regard to JP 2015-232384 A, heavy equipment configured to lift up a cylinder as one part of a reciprocating compressor is required because the cylinder is carried to the outside through the opening portion formed on the roof of the housing. Since it is necessary to prepare heavy equipment, operate the heavy equipment, and further obtain an installation space for the heavy equipment, the conventional compressing device needs a lot of labor for the maintenance of the compressor in the housing.

SUMMARY OF INVENTION

An object of the present invention is to provide techniques for a reduction in labor for maintenance of a compressor.

A compressing device according to one aspect of the present invention includes a compressor having a cylinder portion configured to form a compression chamber in which gas is compressed: a housing having a peripheral wall configured to form an internal space in which the compressor is stored; and a supporting member situated above the compressor in the internal space. The peripheral wall includes an opening wall in which a carry-out port is formed so that the cylinder portion is carried out through the carry-out port. The supporting member extends to guide movement of a first lifting device between a position above the compressor and a position above the carry-out port, the cylinder portion being hung from the first lifting device.

A method according to another aspect of the present invention is used for carrying a cylinder portion of a compressor out of a carry-out port formed in a peripheral wall of a housing configured to an internal space in which the compressor is stored, the cylinder portion forming a compression chamber in which gas is compressed. The method includes lifting the cylinder portion by using a first lifting device supported by a supporting member which is situated above the compressor in the internal space; and moving the first lifting device from a position above the compressor toward a position above the carry-out port along the supporting member to carry the cylinder portion to the carry-out port, the cylinder portion being lifted up by the first lifting device.

An object, features and advantages of the aforementioned compressing device and method will become more apparent from detailed description and accompanying drawings set forth below.

DESCRIPTION OF EMBODIMENTS

First Embodiment

Figure 1:
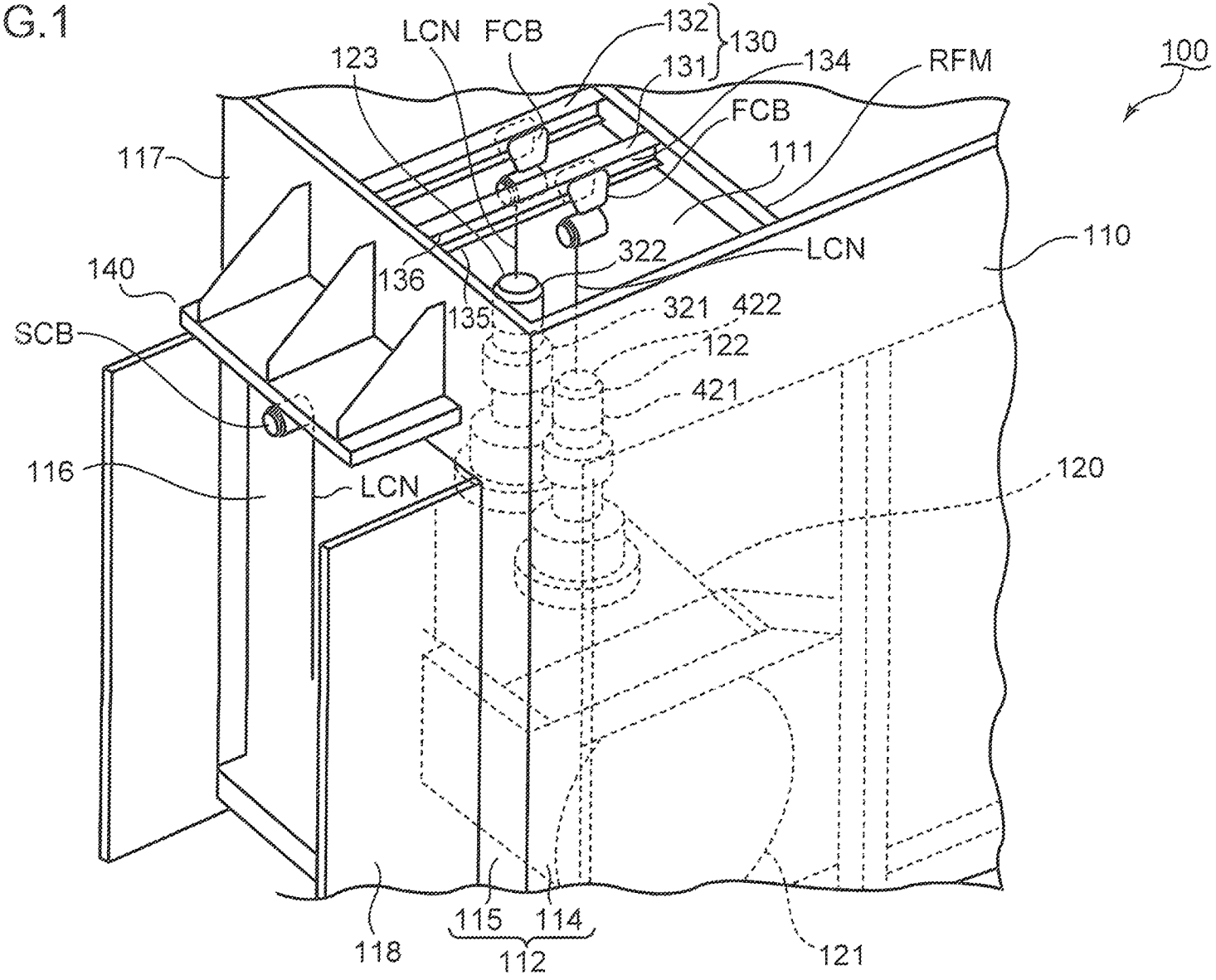
FIG. 1 is a schematic perspective view of a part of a compressing device according to the first embodiment.
Figure 2:
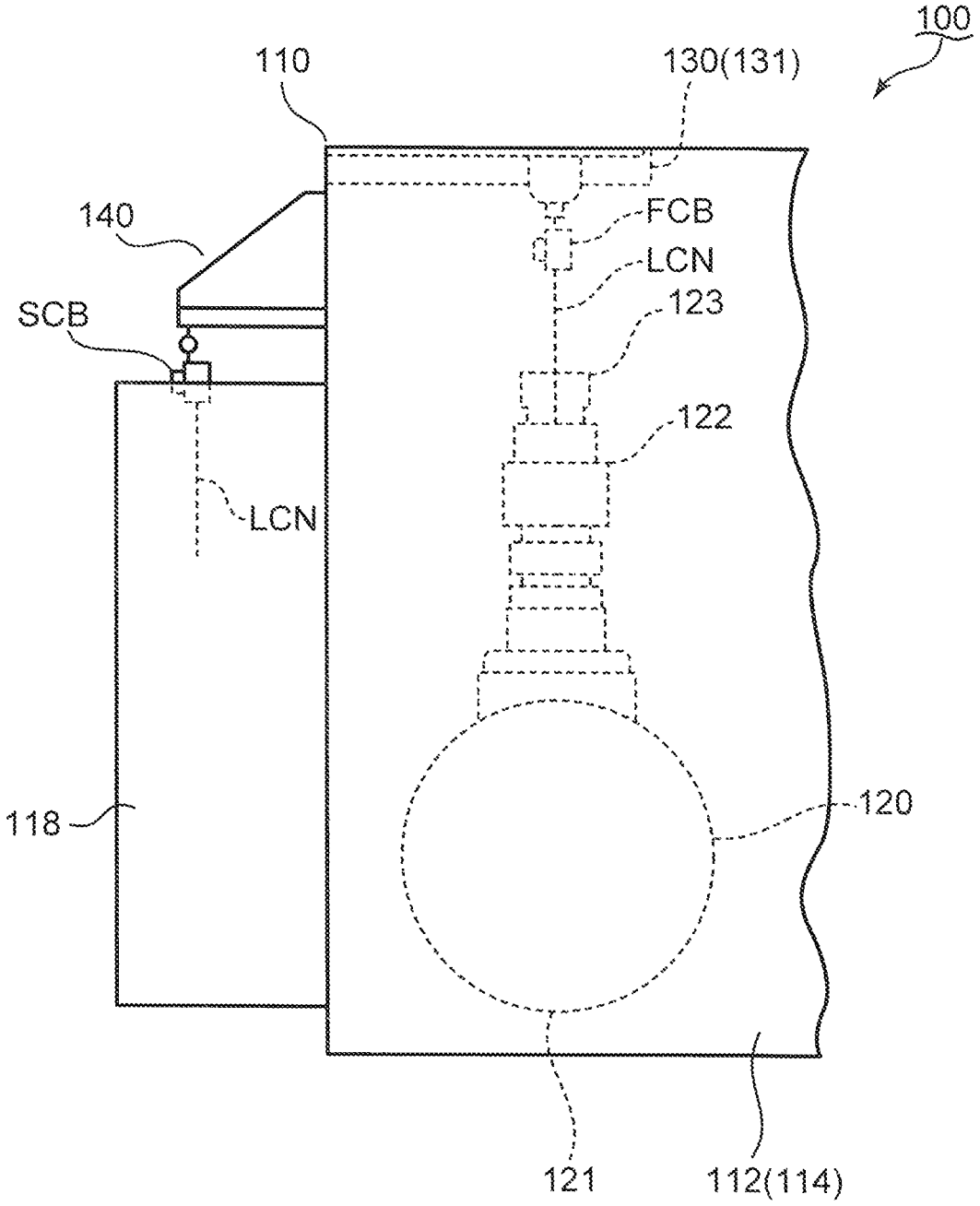
FIG. 2 is a schematic front view of a part of the compressing device.
Figure 3:
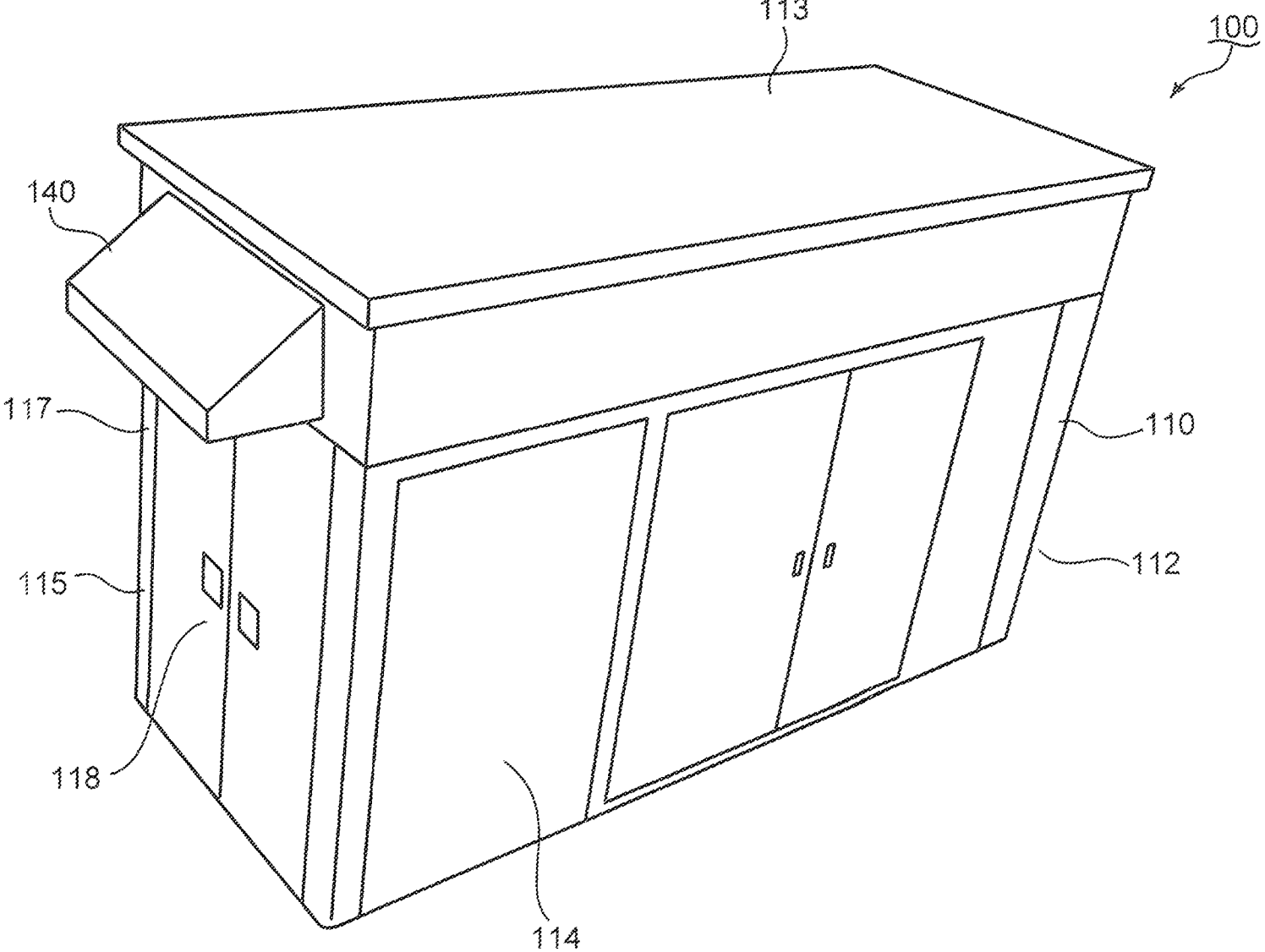
FIG. 3 is a schematic perspective view of the compressing device.

FIG. 1 is a schematic perspective view of a part of a compressing device 100 according to the first embodiment. FIG. 2 is a schematic front view of a part of the compressing device 100. FIG. 3 is a schematic perspective view of the compressing device 100. A schematic structure of the compressing device 100 is described with reference to FIGS. 1 to 3.

The compressing device 100 is used for generating compressed gas (i.e. hydrogen). The compressing device 100 includes a housing 110, a compressor 120 situated in the housing 110, a supporting structure 130 situated above the compressor 120 in the housing 110, and a canopy 140 attached to an outer surface of the housing 110. The housing 110 forms an internal space 111 (c.f. FIG. 1) in which the compressor 120 and the supporting structure 130 are stored. Not only the compressor 120 and the supporting structure 130 but also various devices (e.g. a heat exchanger) required for generating compressed gas (not shown) are stored in the internal space 111. The compressor 120 fixed in the internal space 111 compresses gas. When a maintenance work of the compressor 120 is conducted, the supporting structure 130 is used for lifting up a part of the compressor 120 in the housing 110. The canopy 140 situated outside the housing 110 not only protects workers getting into and out of the internal space 11 against rain but is also used for carrying out a part of the compressor 120 to the outside of the housing 110 when the maintenance work of the compressor 120 is conducted. Structures of the housing 110, the canopy 140, the compressor 120 and the supporting structure 130 are described below.

The housing 110 is a rectangular box (c.f. FIG. 3) having a peripheral wall 112 standing so as to surround the compressor 120, and a roof 113 formed to close a rectangular opening portion surrounded by the upper edge of the peripheral wall 112. Accordingly, the peripheral wall 112 of the housing 110 includes four wall portions forming four surfaces. A wide wall portion of the peripheral wall 112 shown in FIG. 3 is referred to as "front wall 114" in the following description. A wall portion forming a surface extending backward from a left edge of the front wall 114 is referred to as "left wall 115". According to the names of these wall portions, directional terms such as "front", "rear", "left" and "right" are used below. These directions are only for clarifying the description but not to be construed as limiting in any manner.

The left wall 115 of the housing 110 includes an opening wall 117, in which a substantially rectangular carry-out port 116 (c.f. FIG. 1) is formed so that a part of the compressor 120 is carried out from the carry-out port 116, and a door 118 which opens and closes the carry-out port 116. The door 118 shown in FIGS. 1 and 2 opens the carry-out port 116. The door 118 shown in FIG. 3 closes the carry-out port 116. The carry-out port 116 is used not only for carrying out the compressor 120 but also for allowing the workers to get into and out of the internal space 111.

Above the carry-out port 116, the canopy 140 is fixed to the outer surface of the opening wall 117.

The workers may open the door 118 below the canopy 140 to enter the internal space 111. There is a work space around the compressor 120, the work space being wide enough for the workers to disassemble the compressor 120 in the internal space 111. A structure of the compressor 120 is described below.

Figure 4:
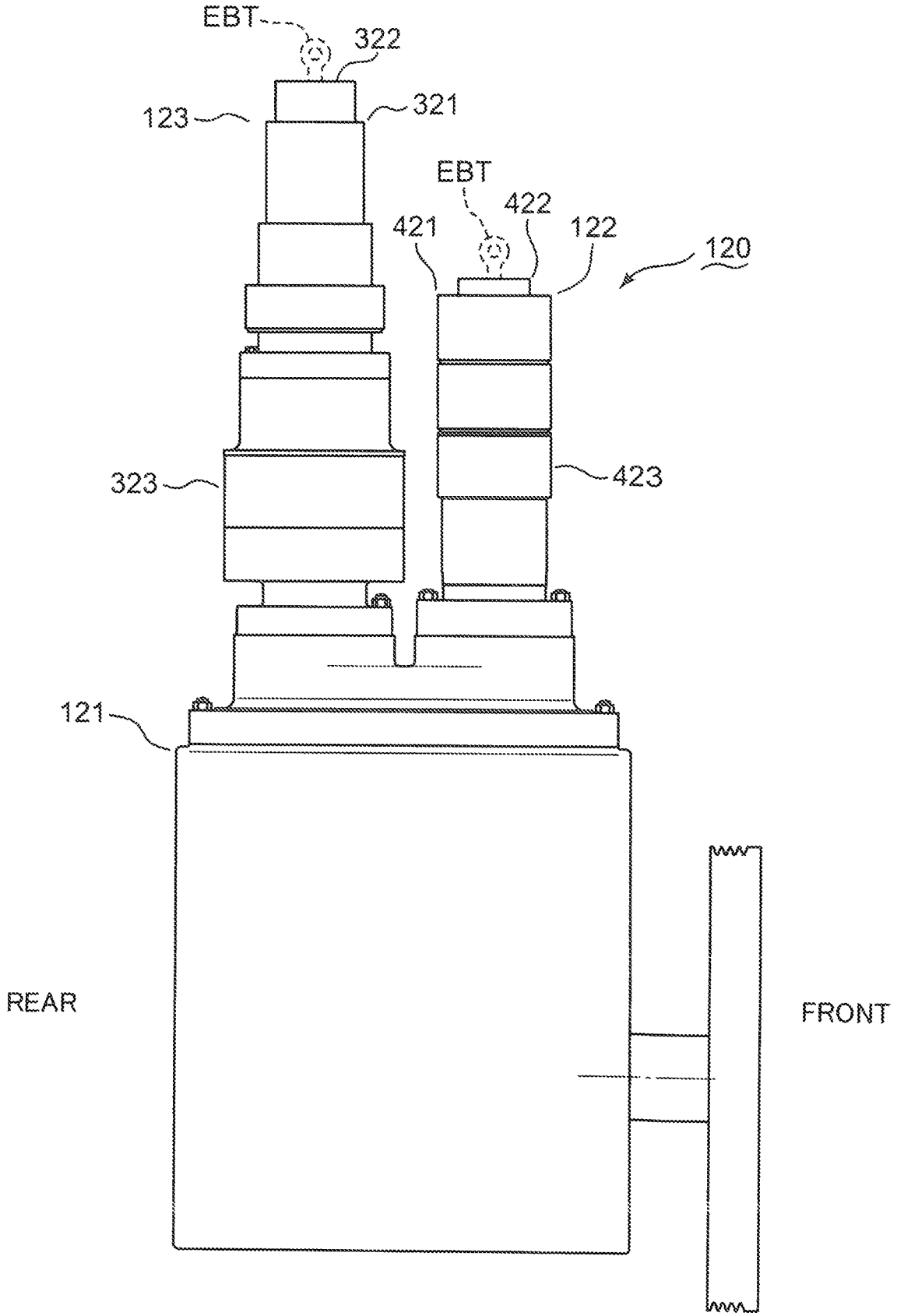
FIG. 4 is a schematic sectional view of the compressing device.

FIG. 4 is a schematic sectional view of the compressor 120. The structure of the compressor 120 is schematically described with reference to FIGS. 1 and 4.

The compressor 120 includes a crank mechanism 121, a first compression portion 122 situated above the crank mechanism 121, and a second compression portion 123 situated above the crank mechanism 121 behind the first compression portion 122. Gas is compressed in the first and second compression portions 122, 123 under an operation of the crank mechanism 121.

The first compression portion 122 includes a piston configured to reciprocate vertically (not shown), and a cylinder portion 421 in which the piston is stored. The piston and the cylinder portion 421 form a compression chamber (not shown) in which the gas is compressed.

The cylinder portion 421 includes a substantially tubular member 423 forming a housing space in which the piston is stored, and a distal end portion 422 which closes the upper portion of the substantially tubular member 423. A space surrounded by the distal end portion 422, the substantially tubular member 423 and the piston is used as a compression chamber in which the gas is compressed.

The second compression portion 123 is situated behind the cylinder portion 421 formed by the substantially tubular member 423 and the distal end portion 422. The second compression portion 123 includes a piston configured to reciprocate vertically (not shown), and a cylinder portion 321 in which the piston is stored. The cylinder portion 321 includes a substantially tubular member 323 forming a housing space in which the piston is stored, and a distal end portion 322 closing the upper portion of the substantially tubular member 323. A space surrounded by the distal end portion 322, the substantially tubular member 323 and the piston is used as a compression chamber in which the gas is compressed.

Bolt holes (not shown) are formed in the upper surfaces of the distal end portions 322, 422 of the first and second compression portions 122, 123, respectively. Eyebolts EBTs are screwed into the bolt holes when the maintenance work of the compressor 120 is conducted.

The eyebolts EBTs attached to the distal end portions 322, 422 are connected to lifting wires LCN of two first lifting devices FCB shown above the compressor 120 in FIG. 1 at the time of the maintenance work. These first lifting devices FCBs are used for lifting the cylinder portions 321, 421 in the internal space 111. A chain block with a wheel is used as each of these first lifting devices FCBs. However, another device capable of lifting the cylinder portions 321, 421 may be used as the first lifting device FCB. When a chain block is used as the first lifting device FCB, the lifting wire LCN is a chain. However, the lifting wire LCN may be a wire which is strong enough for lifting the cylinder portions 321, 421.

The two first lifting devices FCB which lift the cylinder portions 321, 421 are supported by the supporting structure 130. The supporting structure 130 is described below with reference to FIGS. 1 and 3.

The supporting structure 130 includes two supporting members which support the two first lifting devices FCB, respectively. One of the two supporting members is situated in correspondence to the first compression portion 122, and is referred to as "first supporting member 131" in the following description. The other supporting member is situated in correspondence to the second compression portion 123, and is referred to as "second supporting member 132" in the following description.

Right ends of the first and second supporting members 131, 132 are connected to a reinforcing frame RFM extending backward from the front wall 114, the reinforcing frame RFM being provided on the right of the left wall 115 to reinforce the housing 110. Left ends of the first and second supporting members 131, 132 are connected to another reinforcing frame (not shown) situated above the carry-out port 116, the other reinforcing frame extending substantially horizontally along the inner surface of the left wall 115. Accordingly, the first and second supporting members 131, 132 extends rightward from the inner surface of the left wall 115. The first supporting member 131 is substantially in parallel to the second supporting member 132.

The first supporting member 131 is situated above the first compression portion 122. The first supporting member 131 is not necessarily positioned immediately above the first compression portion 122. The second supporting member 132 behind the first supporting member 131 is positioned above the second compression portion 123. The second supporting member 132 is not necessarily positioned immediately above the second compression portion 123. The second supporting member 132 is substantially the same in structure and shape as the first supporting member 131. Accordingly, the following description about the structure and the shape of the first supporting member 131 is applicable to the second supporting member 132.

The first supporting member 131 includes an intermediate plate portion 134, which forms substantially vertical front and rear surfaces, a lower plate portion 135, which protrudes forward and rearward from the lower edge of the intermediate plate portion 134, and an upper plate portion 136, which protrudes forward and rearward from the upper edge of the intermediate plate portion 134. Since the first supporting member 131 has the H-shaped cross section, an H-shaped steel may be used as the first supporting member 131.

The wheel of the chain block (not shown) used as the first lifting device FCB is inserted into a gap between the upper and lower plate portions 136, 135 of the first supporting member 131, so that the chain block is supported by the first supporting member 131. The wheel of the chain block rotates on the upper surface of the lower plate portion 135 so that the chain block moves leftward and rightward along the first supporting member 131.

When the chain block moves from the position above the compressor 120 to the left end of the first supporting member 131 (or the second supporting member 132) (i.e. a position above the carry-out port 116) with lifting the cylinder portion 421 (or 321), the cylinder portion 421 (or 321) hung below the chain block is carried near the carry-out port 116. A second lifting device SCB is attached to a lower part of the canopy 140 in order to carry the cylinder portion 421 (or 321), which has been carried near the carry-out port 116, to the outside of the housing 110 through the carry-out port 116. In short, the canopy 140 is formed so that the second lifting device SCB is attached, the canopy 140 being strong enough to support the cylinder portion 421 (or 321).

The second lifting device SCB is attached to the lower part of the canopy 140 whereas the first lifting devices FCB are supported by the first and second supporting member 131, 132 extending along the lower surface of the roof 113 (c.f, FIG. 3) at a higher position of the canopy 140. Accordingly, the arrangement position of the second lifting device SCB is lower than the arrangement position of the first lifting device FCB.

Like the first lifting device FCB, the second lifting device SCB may be a chain block. However, another device capable of lifting the cylinder portion 421 (or 321) may be used as the second lifting device SCB. When a chain block is used as the second lifting device SCB, the lifting wire LCN of the second lifting device SCB is a chain. However, the lifting wire LCN of the second lifting device SCB may be a wire which is strong enough for lifting the cylinder portion 421 (or 321).

The second and first lifting devices SCB, FCB, and the canopy 140 and the supporting structure 130 supporting the second and first lifting devices SCB, FCB, respectively, are used for the maintenance work of the compressor 120. Exemplary maintenance work of the compressor 120 is described below.

When the maintenance work is started, the workers install the lifting devices. One of the two first lifting devices FCB is attached to the first supporting member 131 so that the first lifting device FCB is situated above the cylinder portion 421 of the first compression portion 122. The other first lifting device FCB is attached to the second supporting member 132 so that the other first lifting device FCB is situated above the cylinder portion 321 of the second compression portion 123. The second lifting device SCB is attached to the canopy 140.

After the installation work of the lifting devices FCB, SCB, the workers disassemble the cylinder portion as a conveyance object (i.e. either of the cylinder portion 321 or 421) from a crank case of the crank mechanism 121. Consequently, the cylinder portion to be carried out becomes separable from the crank case of the crank mechanism 121. Thereafter, a conveyance work is conducted to carry out the cylinder portion as the conveyance object to the outside of the housing 110.

The conveyance work is roughly divided into a work of carrying the cylinder portion as the conveyance object to the carry-out port 116 and a work of carrying the cylinder portion as the conveyance object to the outside of the housing 110 through the carry-out port 116. These works are described below.

Figure 5:
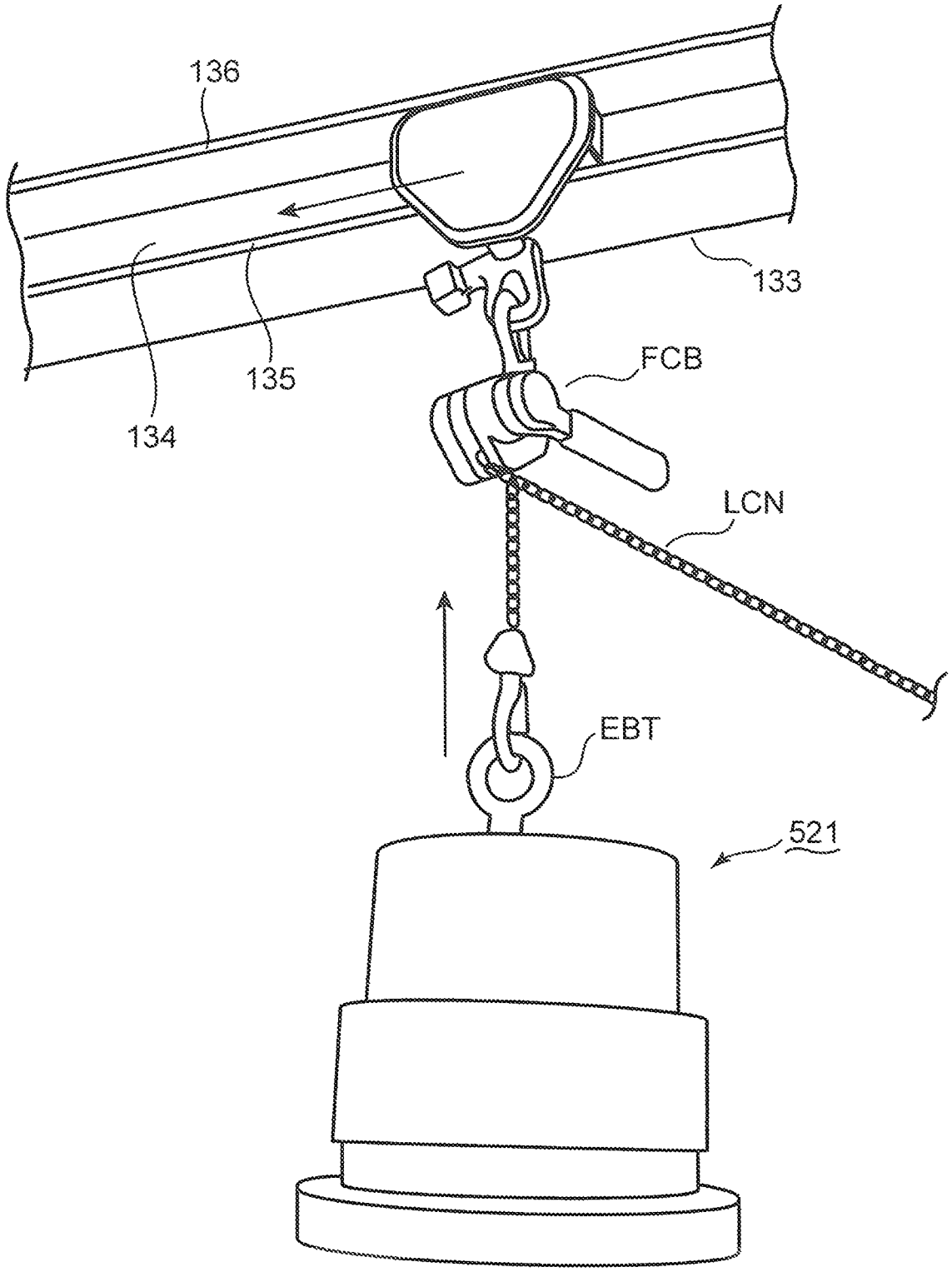
FIG. 5 is a schematic perspective view of a cylinder portion as a conveyance object which is carried toward a carry-out port of the compressing device.

FIG. 5 is a schematic perspective view of a cylinder portion 521 as the conveyance object (i.e. either of the cylinder portion 321 or 421) to the carry-out port 116. It is described below with reference to FIGS. 1 and 5 how to carry the cylinder portion 521 as the conveyance object to the carry-out port 116.

With regard to the work of carrying the cylinder portion 521 as the conveyance object to the carry-out port 116, the workers attach the eyebolt EBT to a distal end portion of the cylinder portion 521 (i.e. either the distal end portion 322 or 422 shown in FIG. 1) at first. The workers attach a hook at the lower end of the lifting wire LCN of the first lifting device FCB to the eyebolt EBT. The workers operate the first lifting device FCB to wind up the lifting wire LCN. Accordingly, the cylinder portion 521 moves upward and is separated from the crank case of the crank mechanism 121.

After the lifting wire LCN is wound up, the workers move the first lifting device FCB along a supporting member 133 (i.e. either of the first or second supporting member 131, 132 shown in FIG. 1). Accordingly, the cylinder portion 521 hung from the first lifting device FCB moves toward the carry-out port 116. It is described below how to carry out the cylinder portion 521 from the housing 110 through the carry-out port 116, the cylinder portion 521 having been carried near the carry-out port 116.

Figure 6:
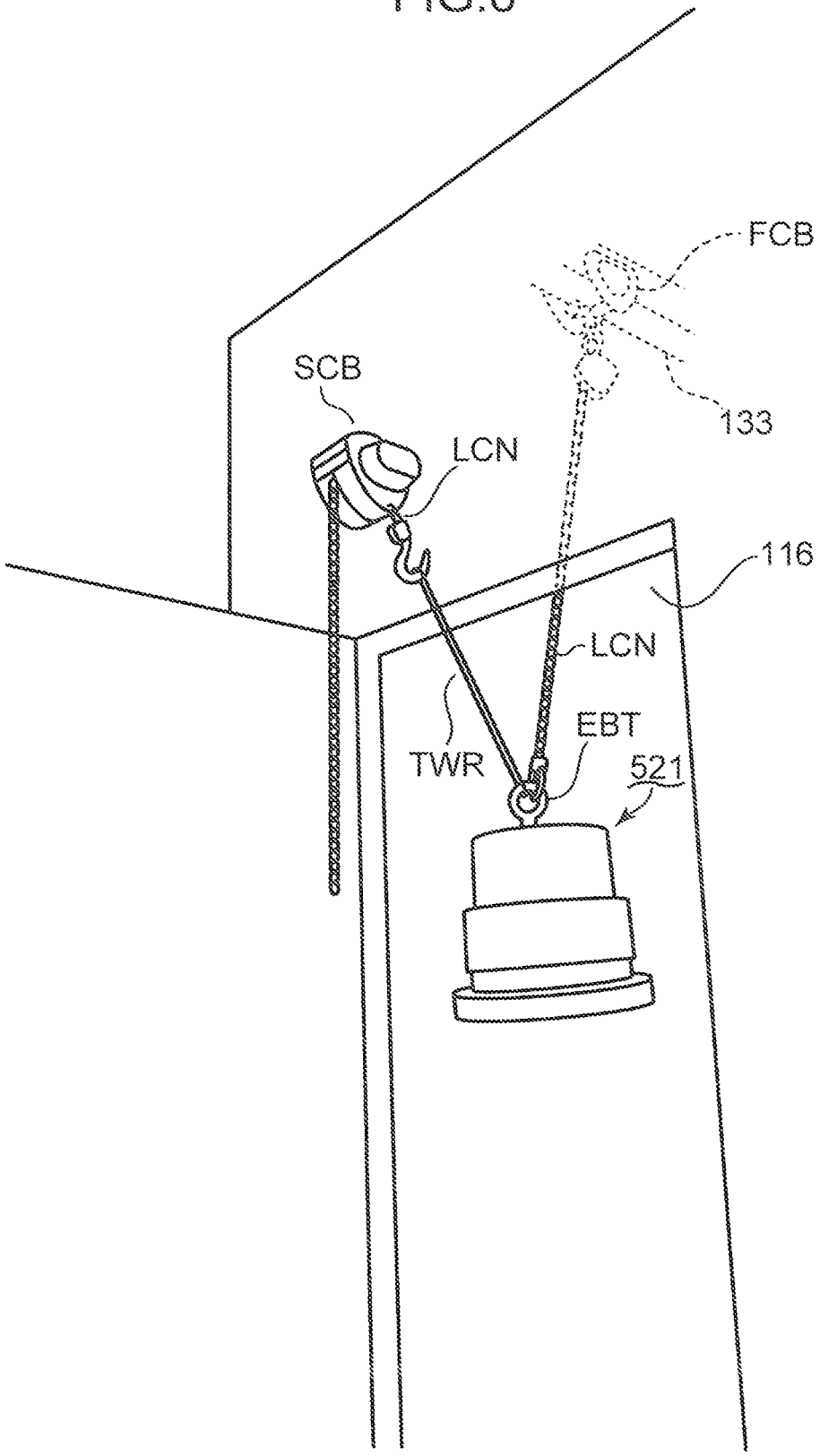
FIG. 6 is a schematic perspective view of the cylinder portion carried near the carry-out port.

FIG. 6 is a schematic perspective view of the cylinder portion 521 which has been carried near the carry-out port 116. The conveyance work of the cylinder portion 521 is described with reference to FIG. 6.

When the workers move the first lifting device FCB near the left end of the supporting member 133, the cylinder portion 521 is positioned near the inner surface of the left wall 115. The workers then operates the first lifting device FCB to move the cylinder portion 521 down so that the upper end of the cylinder portion 521 is positioned below the upper edge of the carry-out port 116.

When the cylinder portion 521 moves down to an appropriate height position, the workers attach an end portion of a traction wire TWR to the hook attached to the end portion of the lifting wire LCN of the second lifting device SCB. Meanwhile, the other end portion of the traction wire TWR is connected to the eyebolt EBT which is attached to the cylinder portion 521. Since the traction wire TWR and the lifting wire LCN of the second lifting device SCB, to which the traction wire TWR is tied, obliquely extend to the lower right from the second lifting device SCB outside the housing 110 toward the cylinder portion 521 in the housing 110, one of component forces of tension acting on the traction wire TWR and the lifting wire LCN of the second lifting device SCB is oriented leftward. Since the carry-out port 116 is formed on the left side of the cylinder portion 521, when the workers loosen the lifting wire LCN of the first lifting device FCB whereas the workers wind up the lifting wire LCN of the second lifting device SCB, the cylinder portion 521 is lifted upward and leftward so that the cylinder portion 521 is carried out of the housing 110 through the carry-out port 116.

The first and second lifting devices FCB, SCB are used for the aforementioned maintenance work. A device having a size that can be arranged in the housing 110 (e.g. a chain block) may be used as the first and second lifting devices FCB, SCB. Accordingly, the workers may manually attach the first and second lifting devices FCB, SCB to a predetermined work position to carry the cylinder portions 321, 421 separated from the compressor 120 to the outside of the housing 110. The maintenance work is conducted with less labor than a case where a cylinder portion is drawn out by heavy equipment through an opening formed in a ceiling portion of a housing.

The canopy 140, to which the second lifting device SCB is attached, protects the cylinder portion 521 carried out of the carry-out port 116 and the workers conducting the maintenance work against rain.

With regard to the aforementioned embodiment, the compressor 120 has the two cylinder portions 321, 421. However, the aforementioned carry-out techniques are applicable also to a compressor having one cylinder portion and a compressor having more than two cylinder portions.

With regard to the aforementioned embodiment, the first and second supporting members 131, 132 in correspondence to the cylinder portions 321, 421 are situated in the housing 110. However, it may depend on a structure of a compressor how many supporting members are arranged in the housing. Accordingly, when a compressor has one cylinder portion, one supporting member may be arranged in the housing. Further, one supporting member may be arranged for cylinder portions although it depends on a distance between the cylinder portion and the supporting member, and an interval between the cylinder portions. In this case, one lifting device FCB is used for lifting the cylinder portions in the housing 110.

With regard to the aforementioned embodiment, the cylinder portions 321, 421 are carried to the outside of the housing 110 through the carry-out port 116 by the second lifting device SCB after being carried near the carry-out port 116 by the first lifting device FCB. However, the cylinder portions 321, 421 may be carried out by a hand cart or the like near the carry-out port 116. In this case, the second lifting device SCB is not required.

A single compression chamber or compression chambers may be formed in the cylinder portion 521 described in the context of the aforementioned embodiment. When the single compression chamber is formed in the cylinder portion 521, one piston is stored in the cylinder portion 521. When the compression chambers are formed in the cylinder portion 521, pistons are stored in the cylinder portion 521.

The cylinder portion 521 described in the context of the aforementioned embodiment may be configured with divisional parts. For example, the substantially tubular member 323 or 423 of the cylinder portion 521 may be configured with tubular elements.

With regard to the aforementioned embodiment, the cylinder portion 521 is lifted up alone. However, together with the cylinder portion 521, other members of the compressing device 100 (e.g. a gas cooler or a piston) may be lifted up.

With regard to the aforementioned embodiment, the central axes of the cylinder portions 321, 421 extend vertically. However, the aforementioned carry-out techniques may be used for a compressing device which has a cylinder portion of which central axis extends horizontally. In this case, the laterally detached cylinder portion is raised by the first lifting device FCB so that the central axis extends vertically. Then, after being raised up by the first lifting device FCB, the cylinder portion is horizontally moved toward the carry-out port 116. Eventually, the cylinder portion is carried out of the housing 110 through the carry-out port 116 by the second lifting device SCB outside the housing 110.

With regard to the aforementioned embodiment, the cylinder portions 321, 421 and the crank case of the crank mechanism 121 are disassembled after the installation of the first and second lifting devices FCB, SCB. However, the cylinder portions 321, 421 and the crank case of the crank mechanism 121 may be disassembled before or during the installation of the first and second lifting devices FCB, SCB.

With regard to the aforementioned embodiment, the first and second lifting devices FCB, SCB are installed to the supporting member 133 and the canopy 140 at the start of the maintenance work. However, the first and second lifting devices FCB, SCB may be always placed on the supporting member 133 and the canopy 140, respectively.

With regard to the aforementioned embodiment, the H-shaped steel is used as the supporting member 133. However, the supporting member 133 may have another shape (e.g. a member having an I-shaped or C-shaped cross section) which guides horizontal movement of the first lifting device FCB. If a device for use together with a dedicated rail member is used as the first lifting device FCB, the dedicated rail is used as the supporting member.

With regard to the aforementioned embodiment, the first lifting device FCB is attached to the supporting member 133 whereas the second lifting device SCB is attached to the canopy 140. However, the first and second lifting devices FCB, SCB may be attached to a common beam member. For example, an H-shaped steel extending through the opening wall 117 above the carry-out port 116 may be used as a beam member. In this case, the first lifting device FCB is attached to the H-shaped steel in the internal space 111, and the second lifting device SCB is attached to the H-shaped steel outside the housing 110. The first and second lifting devices FCB, SCB attached to the common H-shaped steel are supported at substantially the same height.

Second Embodiment

Since the canopy 140 of the compressing device 100 according to the first embodiment protrudes outward from the opening wall 117 above the carry-out port 116, the canopy is suitably used as an attachment part of the second lifting device SCB which pulls the cylinder portion 521 outward. However, another protrusion member instead of the canopy 140 may be used as an attachment part of the second lifting device SCB. An alternative protrusion member is described in the second embodiment.

Figure 7:
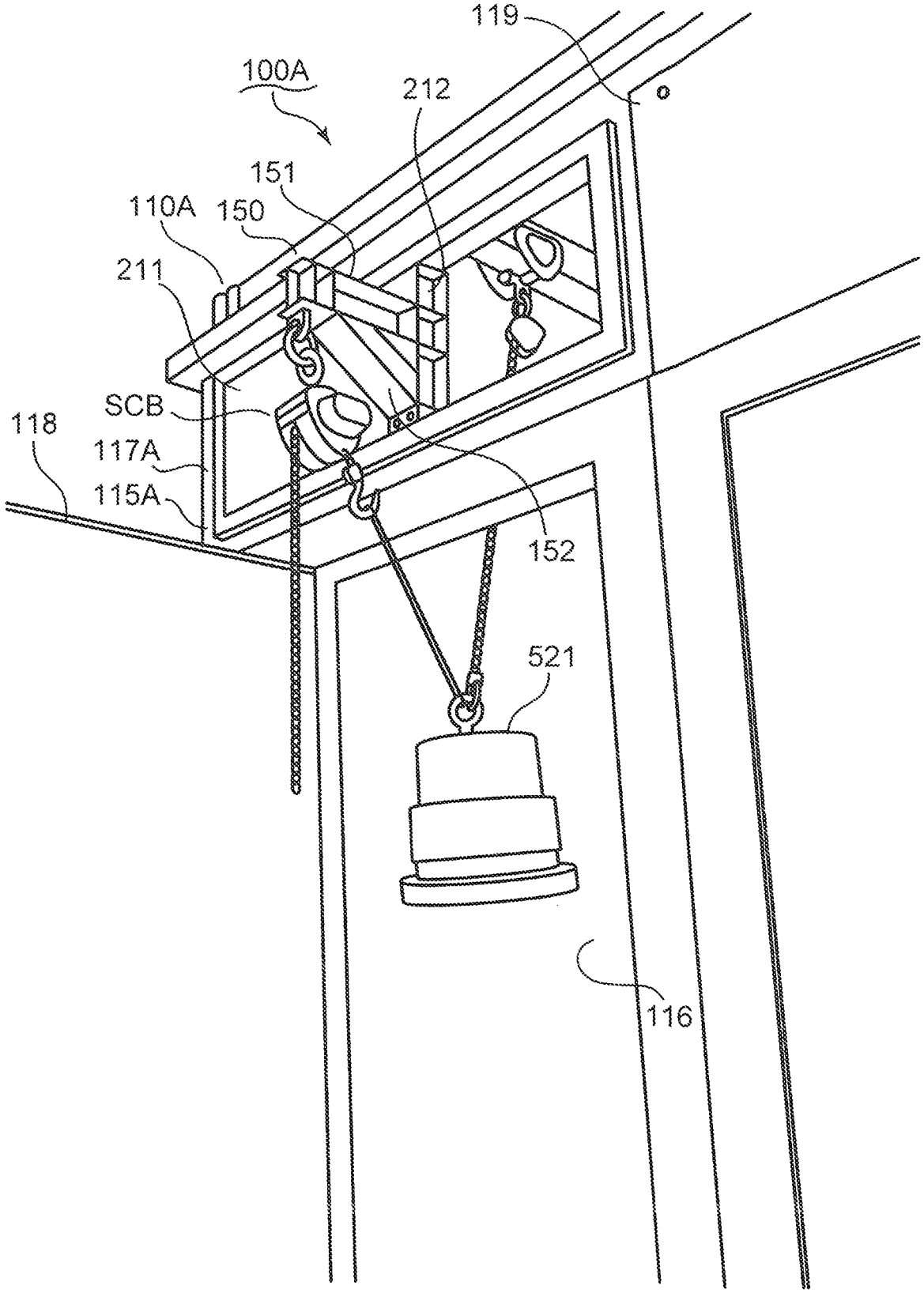
FIG. 7 is a schematic perspective view of a part of a compressing device according to the second embodiment.

FIG. 7 is a schematic perspective view of a part of a compressing device 100A according to the second embodiment. The compressing device 100A is described with reference to FIGS. 1 and 7.

The compressing device 100A is different from the compressing device 100 of the first embodiment only in a structure for supporting the second lifting device SCB. The description of the first embodiment is applicable to the compressing device 100A except for the supporting structure for the second lifting device SCB.

As the supporting structure for the second lifting device SCB, the compressing device 100A has a housing 110A and a supporting frame 150. The housing 110A has a left wall 115A instead of the left wall 115 described in the context of the first embodiment, two opening regions 211 being formed above the carry-out port 116 in the left wall 115A (FIG. 7 shows one of the two opening regions 211). The supporting frame 150 attached to the left wall 115A is used as a protrusion member which is substituted for the canopy 140 described in the context of the first embodiment. Like the canopy 140 of the first embodiment, the supporting frame 150 is attached to the left wall 115A. The second lifting device SCB is attached to the supporting frame 150. Structures of the left wall 115A and the supporting frame 150 are described below.

Like the first embodiment, the left wall 115A includes the door 118. The description of the first embodiment is applicable to the door 118.

In addition to the door 118, the left wall 115A includes an opening wall 117A and two covers 119 attached to the upper portion of the opening wall 117A (FIG. 7 shows one of the two covers 119). The carry-out port 116 and the aforementioned two opening regions 211 are formed in the opening wall 117A. The two covers 119 are formed to close the two opening regions 211. The cover 119 shown in FIG. 7 closes the front opening region 211 whereas the cover 119 for closing the rear opening region 211 is detached. Accordingly, the rear opening region 211 appears in FIG. 7.

The cover 119 for closing the rear opening region 211 is detached when the cylinder portion 321 of the second compression portion 123 is carried out through the carry-out port 116 as shown in FIG. 7. On the other hand, the cover 119 for closing the front opening region 211 is detached when the cylinder portion 421 of the first compression portion 122 is carried out through the carry-out port 116.

When the cover 119 is detached, a strut 212 appears, the strut 212 extending vertically so as to divide the opening region 211 into two regions. The strut 212 is incorporated into the opening wall 117A as a part of the left wall 115A in order to enhance a strength of the left wall 115A around the opening region 211.

The supporting frame 150 is attached to the strut 212 using a bolt (not shown). The supporting frame 150 includes an upper frame member 151 extending substantially horizontally from the strut 212 and a lower frame member 152 extending obliquely downward from the lower surface of the upper frame member 151 toward the left surface of the strut 212. The second lifting device SCB is attached to the left end of the lower surface of the upper frame member 151. When the second lifting device SCB lifts up the cylinder portion 321, loads of the cylinder portion 321 and the second lifting device SCB are applied to the left end of the upper frame member 151. Accordingly, the upper frame member 151 is about to bend downward. The lower frame member 152 arranged below the upper frame member 151 suppresses downward bending of the upper frame member 151. Accordingly, the supporting frame 150 has a structure capable of satisfactorily enduring a heavy load of the cylinder portion 321.

The workers may conduct the same maintenance work as in the first embodiment by using the second lifting device SCB attached to the supporting frame 150 to carry out the cylinder portion 521 from the housing 110A through the carry-out port 116. After the maintenance work, the workers detach the supporting frame 150 from the strut 212. Thereafter, the workers close the opening region 211 with the cover 119.

Since the workers detach the supporting frame 150 protruding from the left wall 115A at the end of the maintenance work, the supporting frame 150 does not interfere with other works conducted after the maintenance work. Since the supporting frame 150 is designed only for the maintenance work, the supporting frame 150 does not have to be as large as the canopy 140 which is used not only for the maintenance work but also protection of the workers against rain. Accordingly, the supporting frame 150 is formed at low costs.

With regard to the aforementioned embodiment, the supporting frame 150 is attached to the strut 212 which is exposed when the cover 119 is detached. However, the supporting frame 150 may be directly attached to an opening wall having a high strength. In this case, neither the opening region 211 nor the cover 119 which covers the opening region 211 is required.

The disclosed embodiments are for illustrative purpose only and not to be construed as limiting in any manner. The scope of the present invention is demonstrated not by the above description but by the scope of claims and is construed to include meaning equivalent to the scope of claims and all modifications within the scope.

The aforementioned embodiments mainly include a compressing device having the following configuration and a method for carrying out the compressing device.

A compressing device according to one aspect of the aforementioned embodiment includes a compressor having a cylinder portion configured to form a compression chamber in which gas is compressed; a housing having a peripheral wall configured to form an internal space in which the compressor is stored; and a supporting member situated above the compressor in the internal space. The peripheral wall includes an opening wall in which a carry-out port is formed so that the cylinder portion is carried out through the carry-out port. The supporting member extends to guide movement of a first lifting device between a position above the compressor and a position above the carry-out port, the cylinder portion being hung from the first lifting device.

According to the aforementioned configuration, a worker may move the first lifting device from a position above the compressor toward a position above the carry-out port with hanging the cylinder portion from the first lifting device under a guide of the supporting member. Accordingly, the worker may carry the cylinder portion of the compressor toward the carry-out port. Since no heavy equipment is required for carrying the cylinder portion to the carry-out port, there is a reduction in labor for the maintenance of the compressor.

With regard to the aforementioned configuration, the compressing device may further include a protrusion member which protrudes outward from the opening wall above the carry-out port, the protrusion member being configured to support a second lifting device having a lifting wire extending obliquely downward through the carry-out port so that the lifting wire is connected to the cylinder portion which has been carried to the carry-out port.

According to the aforementioned configuration, since the supporting member extends in the internal space of the housing, the cylinder portion stays in the internal space of the housing even when the worker moves the first lifting device along the supporting member. On the other hand, the second lifting device used together with the first lifting device is situated outside the housing since the second lifting device is attached to the protrusion member which protrudes outward from the opening wall above the carry-out port. The lifting wire of the second lifting device extends obliquely downward through the carry-out port and is connected to the cylinder portion since the second lifting device is supported by the protrusion member positioned above the carry-out port outside the housing whereas the cylinder portion stays in the internal space of the housing before the second lifting device lifts up the cylinder portion. When the worker uses the second lifting device to lift up the cylinder portion, one of component forces acting on the lifting wire of the second lifting device is oriented outward, so that the cylinder portion is easily carried to the outside of the housing through the carry-out port.

With regard to the aforementioned configuration, the protrusion member is a canopy provided for the carry-out port.

According to the aforementioned configuration, since the protrusion member is a canopy provided for the carry-out port, the compressing device may protect the cylinder portion against rain when the cylinder portion is carried out of the housing through the carry-out port.

With regard to the aforementioned configuration, the protrusion member is detachable from the opening wall.

According to the aforementioned configuration, since the protrusion member is detachable from the opening wall, the worker may detach the protrusion member from the opening wall after the cylinder portion is carried out of the housing. Accordingly, there is no risk of the protrusion member interfering with other works for the compressing device after a maintenance work of the compressor.

A method according to the aforementioned embodiment is used for carrying a cylinder portion of a compressor out of a carry-out port formed in a peripheral wall of a housing configured to form an internal space in which the compressor is stored, the cylinder portion forming a compression chamber in which gas is compressed. The method includes lifting the cylinder portion by using a first lifting device supported by a supporting member which is situated above the compressor in the internal space; and moving the first lifting device from a position above the compressor toward a position above the carry-out port along the supporting member to carry the cylinder portion to the carry-out port, the cylinder portion being lifted up by the first lifting device.

According to the aforementioned configuration, the first lifting device situated in the internal space of the housing may move from a position above the compressor toward a position above the carry-out port along the supporting member. Therefore, it is possible to carry the cylinder portion to the carry-out port with the cylinder portion being lifted up by the first lifting device, Since no heavy equipment is required for carrying the cylinder portion to the carry-out port, there is a reduction in labor for the maintenance of the compressor.

With regard to the aforementioned configuration, the method further includes connecting a lifting wire to the cylinder portion which has been carried to the carry-out port, the lifting wire extending obliquely downward into the internal space through the carry-out port from a second lifting device which is situated outside the housing; and winding up the lifting wire of the second lifting device to lift up the cylinder portion connected to the lifting wire to carry the cylinder portion out of the carry-out port.

According to the aforementioned configuration, the worker may move the first lifting device along the supporting member to carry the cylinder portion up to a position in front of the carry-out port. The worker may extend the lifting wire obliquely downward from the second lifting device situated outside the housing to connect the lifting wire to the cylinder portion in front of the carry-out port. When the worker winds up the lifting wire of the second lifting device, one of component forces of tension acting on the lifting wire is oriented outward, so that the cylinder portion is easily carried to the outside of the housing through the carry-out port.

The aforementioned techniques enable to reduce labor for maintenance of a compressor.

The principle of the aforementioned embodiments is suitably used in various technical fields requiring compression of gas.

This application is based on Japanese Patent application No. 2018-097114 filed in Japan Patent Office on May 21, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A compressing device comprising:

a compressor having a cylinder portion configured to form a compression chamber in which gas is compressed;

a housing having a peripheral wall configured to form an internal space in which the compressor is stored, the peripheral wall including an opening wall in which a carry-out port is formed so that the cylinder portion is carried out through the carry-out port;

a first lifting device having a lifting wire to be connected to the cylinder portion of the compressor;

a supporting member situated in the internal space above the compressor and extending in the internal space without protruding out of the housing so as to guide movement of the first lifting device configured to lift the cylinder portion, the cylinder portion being allowed to move toward the carry-out port with being hung by the first lifting device when the first lifting device moves along the supporting member;

a protrusion member protruding outward from the opening wall above the carry-out port; and a second lifting device fixed at a lower part of the protrusion member, the second lifting device having a lifting wire for carrying the cylinder portion of the compressor to outside of the housing with connecting the lifting wire to the cylinder portion which has been carried near the carry-out port;

wherein the first lifting device is supported by the supporting member at a position higher than an upper edge of the carry-out port.

2. The compressing device according to claim 1, wherein the protrusion member is a canopy provided for the carry-out port.

3. The compressing device according to claim 1, wherein the protrusion member is detachable from the opening wall.

4. A method for carrying a cylinder portion of a compressor from a carry-out port formed in a peripheral wall of a housing configured to form an internal space in which the compressor is stored, the cylinder portion forming a compression chamber in which gas is compressed, the method comprising:

connecting a lifting wire of a first lifting device to the cylinder portion of the compressor, the first lifting device being supported by a supporting member at a position higher than an upper edge of the carry-out port, the supporting member being situated above the compressor in the internal space and extending in the internal space without protruding outside the housing;

lifting the cylinder portion by using the first lifting device;

moving the first lifting device along the supporting member to carry the cylinder portion to the carry-out port, the cylinder portion being hung by the first lifting device;

connecting a lifting wire of a second lifting device to the cylinder portion which has been carried to the carry-out port, the lifting wire of the second lifting device extending obliquely downward into the internal space through the carry-out port from the second lifting device fixed at a lower part of a protrusion member protruding outward from the opening wall above the carry-out port; and carrying the cylinder portion out of the carry-out port with the second lifting device by winding up the lifting wire of the second lifting device connected to the cylinder portion.

5. A compressing device comprising:

a compressor having a cylinder portion configured to form a compression chamber in which gas is compressed;

a housing having a peripheral wall configured to form an internal space in which the compressor is stored, the peripheral wall including an opening wall in which a carry-out port is formed so that the cylinder portion is carried out through the carry-out port;

a first lifting device having a lifting wire to be connected to the cylinder portion of the compressor;

a supporting member situated in the internal space above the compressor and extending in the internal space without protruding out of the housing so as to guide movement of the first lifting device configured to lift the cylinder portion, the cylinder portion being allowed to move toward the carry-out port with being hung by the first lifting device when the first lifting device moves along the supporting member;

a protrusion member protruding outward from the opening wall above the carry-out port; and a second lifting device having a lifting wire for carrying the cylinder portion of the compressor to outside of the housing with connecting the lifting wire of the second lifting device to the cylinder portion which has been carried near the carry-out port, the second lifting device being supported by the protrusion member;

wherein the second lifting device is provided at a position lower than the first lifting device.

* * * * *